US007023409B2

(12) United States Patent
Blackson et al.

(10) Patent No.: US 7,023,409 B2
(45) Date of Patent: Apr. 4, 2006

(54) DRIVE SCHEMES FOR GRAY SCALE BISTABLE CHOLESTERIC REFLECTIVE DISPLAYS UTILIZING VARIABLE FREQUENCY PULSES

(75) Inventors: Chris Blackson, Suffield Township, OH (US); Todd Ernst, Tallmadge, OH (US); Xiao-Yang Huang, Stow, OH (US)

(73) Assignee: Kent Displays, Incorporated, Kent, OH (US)

( * ) Notice: Subject to any disclaimer, the term of this patent is extended or adjusted under 35 U.S.C. 154(b) by 325 days.

(21) Appl. No.: 09/780,737

(22) Filed: Feb. 9, 2001

(65) Prior Publication Data

US 2002/0109661 A1 Aug. 15, 2002

(51) Int. Cl.
*G09G 3/36* (2006.01)

(52) U.S. Cl. ..... 345/87; 345/89

(58) Field of Classification Search ..... 345/691, 345/690, 692, 693, 87–101, 103–107, 204, 345/212

See application file for complete search history.

(56) References Cited

U.S. PATENT DOCUMENTS

| | | | | |
|---|---|---|---|---|
| 3,995,942 | A | 12/1976 | Kawakami et al. | 350/160 |
| 4,317,115 | A | 2/1982 | Kawakami et al. | 359/55 |
| 4,514,045 | A | 4/1985 | Huffman et al. | 350/351 |
| 4,626,074 | A | 12/1986 | Crossland et al. | 350/345 |
| 4,636,788 | A | 1/1987 | Hilbrink | 340/804 |
| 4,641,135 | A | 2/1987 | Hilbrink | 340/784 |
| 4,668,049 | A | 5/1987 | Canter et al. | 350/345 |
| 4,705,345 | A | 11/1987 | Ayliffe et al. | 350/350 |
| 4,728,175 | A | 3/1988 | Baron | 350/336 |
| 4,761,058 | A | 8/1988 | Okubo et al. | 350/331 |
| 4,769,639 | A | 9/1988 | Kawamura et al. | 340/784 |
| 4,864,538 | A | 9/1989 | Buzak | 365/128 |
| 4,909,607 | A | 3/1990 | Ross | 350/350 |
| 4,958,915 | A | 9/1990 | Okada et al. | 350/345 |
| 5,036,317 | A | 7/1991 | Buzak | 340/783 |
| 5,132,823 | A | 7/1992 | Kamath et al. | 359/70 |
| 5,168,378 | A | 12/1992 | Black et al. | 359/38 |
| 5,168,380 | A | 12/1992 | Fergason | 359/51 |
| 5,189,535 | A | 2/1993 | Mochizuki et al. | 359/55 |
| 5,196,839 | A * | 3/1993 | Johary et al. | 345/691 |

(Continued)

FOREIGN PATENT DOCUMENTS

EP 0 613 116 A2 8/1994

OTHER PUBLICATIONS

Huang et al., *Transient dielectric study of bistable reflective cholesteric displays and design of rapid drive scheme*, Appl. Phys. Lett. 67 (9) (1995), pp. 1211-1213.

(Continued)

*Primary Examiner*—Vijay Shankar
(74) *Attorney, Agent, or Firm*—Renner Kenner Greive Bobak Taylor & Weber

(57) ABSTRACT

A method of addressing a bistable liquid crystal material having incremental reflectance properties disposed between opposed substrates is disclosed. One substrate has a first plurality of electrodes deposited thereon facing a second substrate which has a second plurality of electrodes disposed thereon. The intersection of the first and second plurality of electrodes forms a plurality of pixels. The addressing method includes applying a predetermined number of pulses to the first plurality of electrodes, and applying a like number of the predetermined number of pulses to the second plurality of electrodes. Each of the predetermined number of pulses has a different frequency, wherein the predetermined number of pulses are applied in a set time period.

17 Claims, 9 Drawing Sheets

U.S. PATENT DOCUMENTS

| | | | | | |
|---|---|---|---|---|---|
| 5,251,048 | A | | 10/1993 | Doane et al. | 359/51 |
| 5,252,954 | A | | 10/1993 | Nagata et al. | 345/95 |
| 5,260,699 | A | | 11/1993 | Lister et al. | 345/97 |
| 5,280,280 | A | | 1/1994 | Hotto | 345/94 |
| 5,285,214 | A | | 2/1994 | Bowry | 345/97 |
| 5,289,175 | A | | 2/1994 | Kawagishi | 359/97 |
| 5,289,300 | A | | 2/1994 | Yamazaki et al. | 359/51 |
| 5,293,261 | A | | 3/1994 | Shashidhar et al. | 359/87 |
| 5,315,101 | A | | 5/1994 | Hughes et al. | 250/208.1 |
| 5,317,332 | A | | 5/1994 | Kanno et al. | 345/101 |
| 5,644,330 | A | * | 7/1997 | Catchpole et al. | 345/95 |
| 5,661,533 | A | | 8/1997 | Wu et al. | 349/169 |
| 5,691,740 | A | | 11/1997 | Onitsuka et al. | 345/96 |
| 5,748,277 | A | * | 5/1998 | Huang et al. | 349/169 |
| 5,933,203 | A | | 8/1999 | Wu et al. | 349/35 |
| 5,986,724 | A | | 11/1999 | Akiyama et al. | 349/41 |
| 6,057,817 | A | | 5/2000 | Ono et al. | 345/94 |
| 6,072,455 | A | * | 6/2000 | Matsui et al. | 345/97 |
| 6,094,187 | A | * | 7/2000 | Jones et al. | 345/690 |
| 6,133,895 | A | * | 10/2000 | Huang | 345/94 |
| 6,154,190 | A | | 11/2000 | Yang et al. | 345/94 |
| 6,268,839 | B1 | * | 7/2001 | Yang et al. | 345/89 |
| 6,320,563 | B1 | * | 11/2001 | Yang et al. | 345/87 |
| 6,362,835 | B1 | * | 3/2002 | Urbanus et al. | 345/692 |

OTHER PUBLICATIONS

Huang et al., *High-Performance Dynamic Drive Scheme for Bistable Reflective Cholesteric Displays*, SID Digest, vol. XXVII (1996), pp. 359-362.

Zhu and Yang, *High-Speed Dynamic Drive Scheme for Bistable Reflective Cholesteric Displays*, SID Digest (1997), pp. 97-100.

Yu and Kwok, *A New Driving Scheme for Reflective Bistable Cholesteric LCDs*, SID 97 Digest (1997), pp. 659-662.

Huang, Miller, and Doane, *Unipolar Implementation for the Dynamic Drive Scheme of Bistable Reflective Cholesteric Displays*, SID 97 Digest (1997), pp. 899-302.

Kozachenko et al., *Hysteresis as a Key Factor for the Fast Control of Reflectivity in Cholesteric LCDs*, 1997 International Display Research Conference Journal, pp. 148-151.

Hashimoto et al., *Invited Paper: Reflective Color Display Using Cholesteric Liquid Crystals*, SID Digest, vol. XXIX (1998), pp. 897-900.

Huang et al., *Transient dielectric study of bistable reflective cholesteric displays and design of rapid drive scheme*, Appl. Phys. Lett. 67 (9) (1995), pp. 1211-1213.

Huang et al., *High-Performance Dynamic Drive Scheme for Bistable Reflective Cholesteric Displays*, SID Digest, vol. XXVII (1996), pp. 359-362.

Zhu and Yang, *High-Speed Dynamic Drive Scheme for Bistable Reflective Cholesteric Displays*, SID Digest (1997), pp. 97-100.

Yu and Kwok, *A New Driving Scheme for Reflective Bistable Cholesteric LCDs*, SID 97 Digest (1997), pp. 659-662.

Huang, Miller, and Doane, *Unipolar Implementation for the Dynamic Drive Scheme of Bistable Reflective Cholesteric Displays*, SID 97 Digest (1997), pp. 889-302.

Kozachenko et al., *Hysteresis as a Key Factor for the Fast Control of Reflective in Cholesteric LCDs*, 1997 International Display Research Conference Journal, pp. 148-151.

Hashimoto et al., *Invited Paper: Reflective Color Display Using Cholesteric Liquid Crystals*, SID Digest, vol. XXIX (1998), pp. 897-900.

* cited by examiner

VOLTS DC
$T_{TOTAL}$
$V_4^+$
$V_{ROW}$ (SEL.)
0
t $V_4^+ - V_1^-$
$V_1^-$
$V_{ROW}$ (UN-SEL.)
0
t $V_3^-$
$2V_1^-$
$V_{COL}$ (F.C.)
0
t $V_4^+$
$V_{COL}$ (PLANAR)
0
t $V_3^-$
$V_{PIXEL}$ (F.C.)
0
$-V_3^-$
t $V_4^+$
$V_{PIXEL}$ (PLANAR)
0
$-V_4^+$
t $V_1^-$
$V_{PIXEL}$ (UN-SEL)
0
$-V_1^-$
t

DRIVE SCHEMES FOR GRAY SCALE BISTABLE CHOLESTERIC REFLECTIVE DISPLAYS UTILIZING VARIABLE FREQUENCY PULSES

TECHNICAL FIELD

The present invention relates generally to drive schemes for liquid crystal displays employing chiral nematic or cholesteric, reflective bistable liquid crystal material. In particular, the present invention relates to drive schemes for cholesteric liquid crystal displays that provide gray scale appearance or reflectivity. Specifically, the present invention is directed to drive schemes that utilize a range of different frequency voltage pulses to drive a portion of the liquid crystal material to a particular texture and attain the desired gray scale appearance.

BACKGROUND ART

Drive schemes for cholesteric liquid crystal displays (ChLCD) are discussed in U.S. patent application Ser. No. 08/852,319, which is incorporated herein by reference. As discussed therein, a gray scale appearance for bistable cholesteric reflective displays is obtained by applying a voltage within a range of voltages during a selection phase, which is one of a series of phases for voltage application pulses, to obtain the desired gray scale appearance. In that disclosed drive scheme, it is only appreciated that the cholesteric material can be driven from a non-reflective focal conic texture to a reflective planar texture. Moreover, when the material is driven from a non-reflective state to a reflective state, no consideration is given to the initial state of the liquid crystal material. In other words, a wide range of voltages is applied to the material, no matter if the material was initially in the focal conic texture or in the twisted planar texture. Accordingly, a wide undefined range of voltage pulses is required to drive the liquid crystal material to obtain a gray scale appearance.

As discussed in U.S. patent application Ser. No. 08/852,319, time modulation of the selection phase voltage may be employed to control the level of gray scale reflectance of the liquid crystal material. However, it has been determined that this method of voltage application may not be suitable for some cholesteric liquid crystal materials.

An improvement of the foregoing method is disclosed in U.S. patent application Ser. No. 09/076,577, which is incorporated herein by reference. The '577 application is directed to a gray scale driving waveform that includes time modulating application of a portion of the waveform pulse in the form of a single bi-level pulse. This pulse includes a first voltage level for a first variable period of time and a second voltage, different than the first voltage level, for a second variable period of time. The sum of the first and second variable periods of time are equal to a set time period. Use of such a pulse is advantageous in that it allows for use of a lower frequency signal which, in turn, results in less power consumption by the display.

The above method has been found to be advantageous over the scheme disclosed in the patent to Wu, U.S. Pat. No. 5,933,203. The gray scale method described in the Wu patent uses a pulse number modulation technique that requires the use of higher frequency electric fields (waveforms or signals) for gray scale implementation. Due to the capacitive load of the cholesteric liquid crystal display, the higher frequency drive signals require significantly more power from the power source. However, the drive scheme disclosed in the '577 application, in combination with the capacitive load of the cholesteric liquid crystal display and the resistances of the electrodes and driver circuitry, causes the rising and falling edges of the waveforms to become "rounded" which lowers the magnitude or area integrated under the waveform outline. It will also be appreciated that the pixel bistable reflectance characteristics depend upon the magnitude of the waveform applied prior to removing the electric field. If the two drive signals, each applied to the electrodes of common cells, have the same amplitude to produce the same reflective characteristics, but the two signals have different drive frequencies, then the drive signal with the higher frequency needs to be applied to the corresponding cell (or pixels) for a longer duration than the lower frequency drive signal. Hence, the gray scale method described in the Wu patent will require a much longer image update duration than desired.

In light of the foregoing, it is evident that there is still a need in the art for drive schemes which more precisely drive cholesteric/chiral nematic liquid crystal material to an appropriate gray scale appearance by using less power. This is also a need for implementing such a drive scheme with either bipolar or unipolar waveforms.

DISCLOSURE OF INVENTION

In light of the foregoing, it is a first aspect of the present invention to provide drive schemes for gray scale bistable cholesteric (chiral nematic) reflective displays.

It is another aspect of the present invention is to provide a cholesteric liquid crystal display cell with opposed substrates, wherein one of the substrates has a plurality of row electrodes and the other substrate has a plurality of column electrodes, and wherein the intersections between the row and column electrodes form picture elements or pixels.

It is a further aspect of the present invention, as set forth above, to provide application of electric fields in a time modulation technique in which a gray scale reflectance is obtained, in a set time period, with application of multiple frequencies, wherein no frequencies are repeated in the set time period.

It is yet another aspect of the present invention, as set forth above, to provide a drive scheme wherein the number of different frequency pulses is proportional to the different number of gray scale or reflectance levels provided by the display.

It is yet another aspect of the present invention, as set forth above, to provide a drive scheme in which the number of reflectances, including full reflectance and full transparent, is equal to the number of different frequencies used in the set time period plus a constant.

It is still another aspect of the present invention, as set forth above, to provide an alternative drive scheme in which the number of reflectances, including full reflectance and full transparent, is equal to the number 2 raised to a value equal to the number of different frequency pulses less 1 (or a constant number) applied to the electrodes.

It is still a further aspect of the present invention, as set forth above, to provide drive schemes in which bipolar or unipolar waveforms are applied.

It is an additional aspect of the present invention, as set forth above, to employ a drive scheme wherein the number of incremental reflectances correspond to a like number of drive periods, and wherein each drive period is a different length of time than all of the other drive periods.

Yet a further aspect of the present invention, as set forth above, is to employ an alternative drive scheme wherein the shortest pulse time period is about half the duration of the next longest pulse time period.

Still yet a further aspect of the present invention, as set forth above, is to employ an alternative drive scheme wherein each time period is at least either about twice as long in duration as the next shortest time period or about half as short in duration as the next longest time period.

The foregoing and other objects of the present invention, which shall become apparent as the detailed description proceeds, are achieved by a method of addressing a bistable liquid crystal material having incremental reflectance properties disposed between opposed substrates, wherein one substrate has a first plurality of electrodes deposited thereon facing the other substrate which has a second plurality of electrodes disposed thereon, the intersection of the first and second plurality of electrodes forming a plurality of pixels, the addressing method comprising applying a predetermined number of pulses to the first plurality of electrodes, applying a like number of the predetermined number of pulses to the second plurality of electrodes, and each of the predetermined number of pulses having a different frequency.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompany drawings wherein.

BEST MODE FOR CARRYING OUT THE INVENTION

Figure 1:
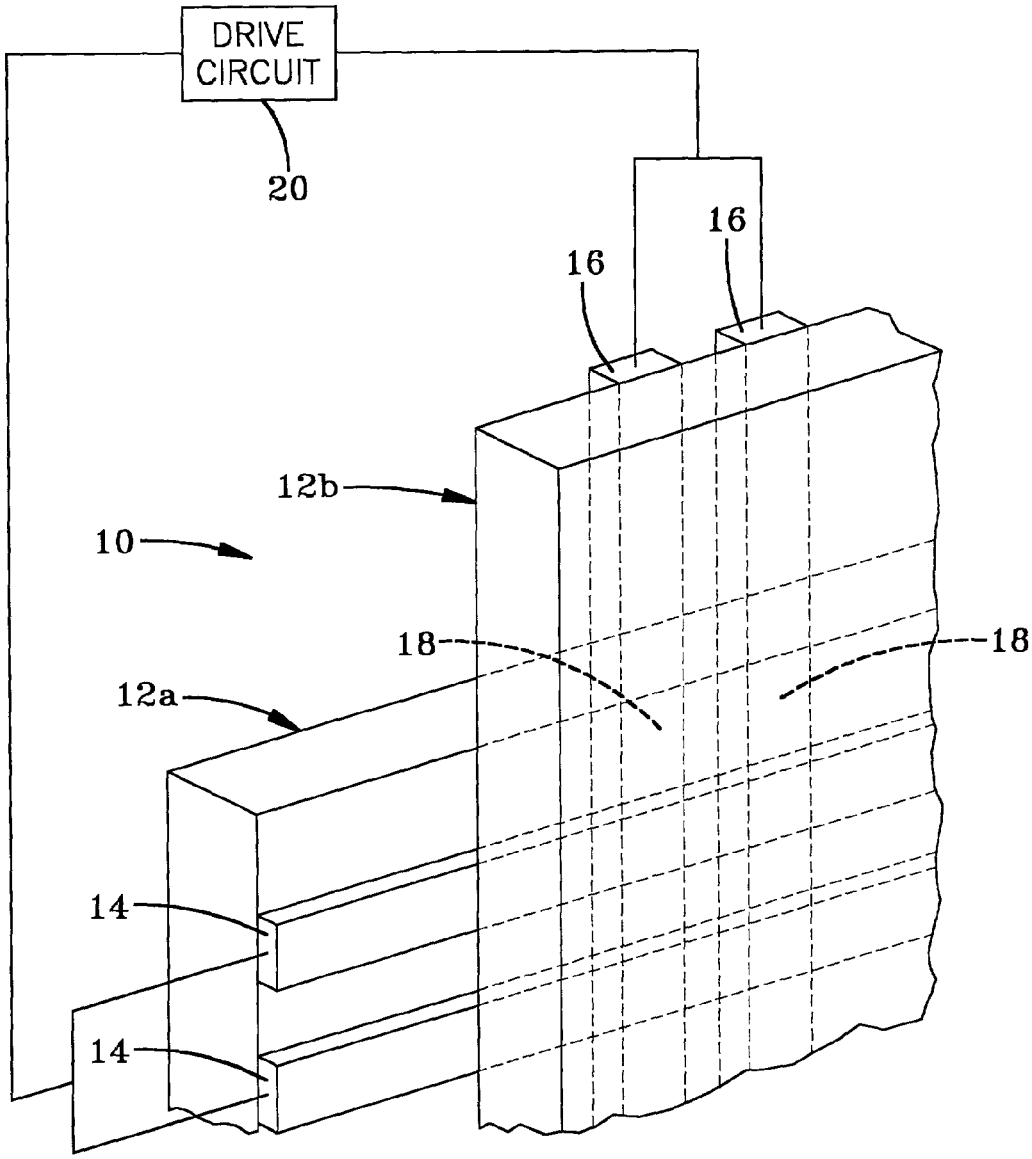
FIG. 1 is a perspective schematic representation of a liquid crystal display using row and column electrodes.

Referring now to the drawings and in particular to FIG. 1, it can be seen that a liquid crystal display, according to the present invention is designated generally by the numeral 10. The display 10 includes opposed substrates 12*a* and 12*b* which may be either glass or plastic materials that are optically clear in appearance. In the present embodiment, a bistable cholesteric liquid crystal material is disposed between the opposed substrates 12 in a manner well-known in the art. The cholesteric material exhibits gray scale properties depending upon a voltage amplitude and duration value applied to the liquid crystal material. In particular, one of the opposed substrates 12*a* includes a plurality of row electrodes 14 facing the opposite substrate 12*b*. Likewise, the other opposed substrate 12*b* provides a plurality of column electrodes 16 which face the opposed substrate 12*a*. By orthogonally orienting the electrodes 14 and 16, a plurality of pixels 18 are formed at the intersections thereof across the entire surface of the liquid crystal display 10. Each of the pixels 18 may be individually addressed so as to generate some type of indicia on the liquid crystal display 10. As will become apparent from the following description, each row electrode 14 and column electrode 16 is addressed by a drive circuit 20 that includes processor controlled electronics (not shown) to a range of voltage amplitude and duration values (the combination of amplitude of duration is sometimes referred to as "magnitude") that drive the cholesteric liquid crystal material to a desired gray scale reflectance or appearance.

Figure 2:
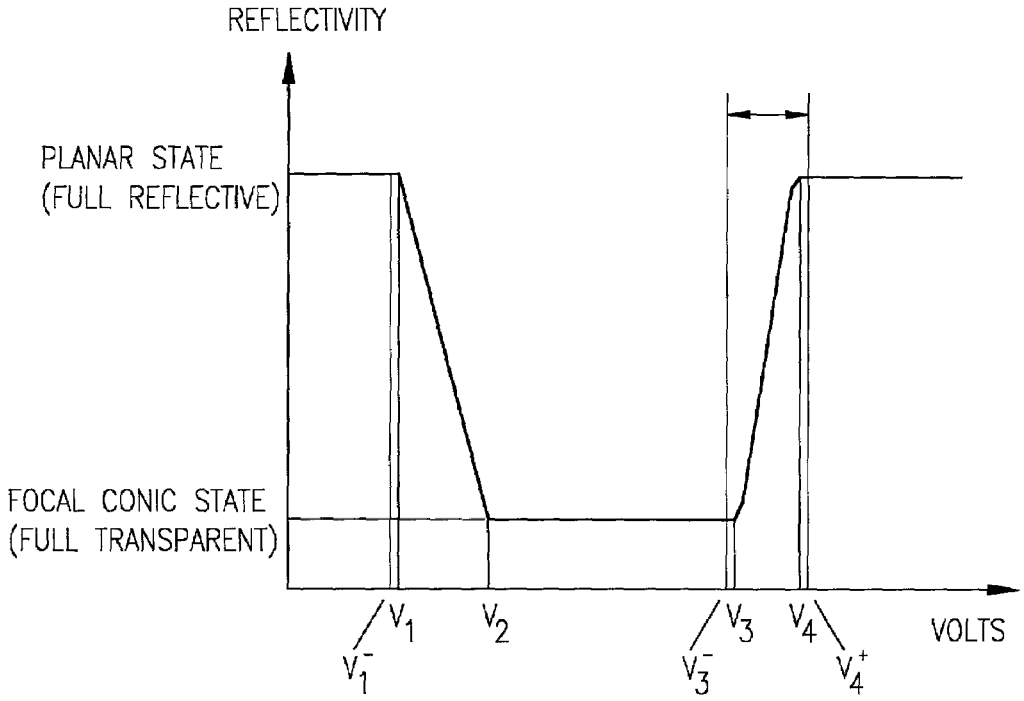
FIG. 2 illustrates a reflectance response of a typical CHLCD pixel to voltage pulses of varying amplitude applied for a fixed duration and fixed mean drive frequency.

FIG. 2 illustrates the reflective characteristics of a given pixel after the application of a drive waveform is removed from the pixel's column and row electrodes. The curve outlined in FIG. 2 assumes the following items:

I. The respective display or pixel has been "reset" or cleared either to the full planar or full focal conic state using the erase techniques known in the art. This is typically done to remove any remains of the previous image, to enable faster update of the current image or pixel update, and improve the image quality after the electric field is removed. Resetting a given number of pixels to a given full on or off state simplifies the image update process and provides much more consistent results.

II. The curve also illustrates how the reflective characteristics of the pixel will change when the voltage pulse amplitudes are varied. The FIG. assumes the duration the voltages are applied and the mean drive frequency of the voltage is constant between different points along the curve illustrated.

As shown in FIG. 2, if the state of the corresponding CHLCD pixel is in the full focal conic or full planar state prior to the application of pulse(s) with amplitude of less than $V_1$ (or "$V_1-$" in FIG. 2) the reflectance of the corresponding pixel will not be altered after the pulses are removed. Likewise, if the amplitudes of pulses are greater than $V_2$, the corresponding pixel(s) will transform to the full focal conic state after the $V_2$ waveforms are removed, regardless of the prior reflectance state of the pixel(s).

In order to create a full reflective planar state for a given number of pixel(s), one needs to apply pulses with amplitudes greater than or equal to $V_4$ (illustrated as "$V_4^+$" in FIG. 2) for the entire duration required. Furthermore, to create a full transparent focal conic state for a given number of pixel(s), one needs to apply pulses with amplitudes less than or equal to $V_3$ (illustrated as "$V_3^-$" in FIG. 2) for the entire duration required. The selected full reflective or full transparent state will appear on the given number of pixels after corresponding pulses are removed from the display section pixel electrodes, or after the corresponding pixel voltage decreases to below the display $V_1$ amplitude.

FIGS. 3A–G illustrate how full reflective and full transparent states can be created for a given pixel using uni-polar drive $V_4^+$ and $V_3^-$ amplitude drive waveforms applied to the corresponding column and row electrodes. It should be noted and known to anyone skilled in the art, that the drive method indicated is not limited to the use of drive signals with amplitudes of $V_3^-$ and $V_4^+$. The respective amplitudes can be altered from the values specified, along with the total duration applied to produce the same or similar results.

Figures 3A, 3B, 3C, 3D, 3E, 3F, 3G:
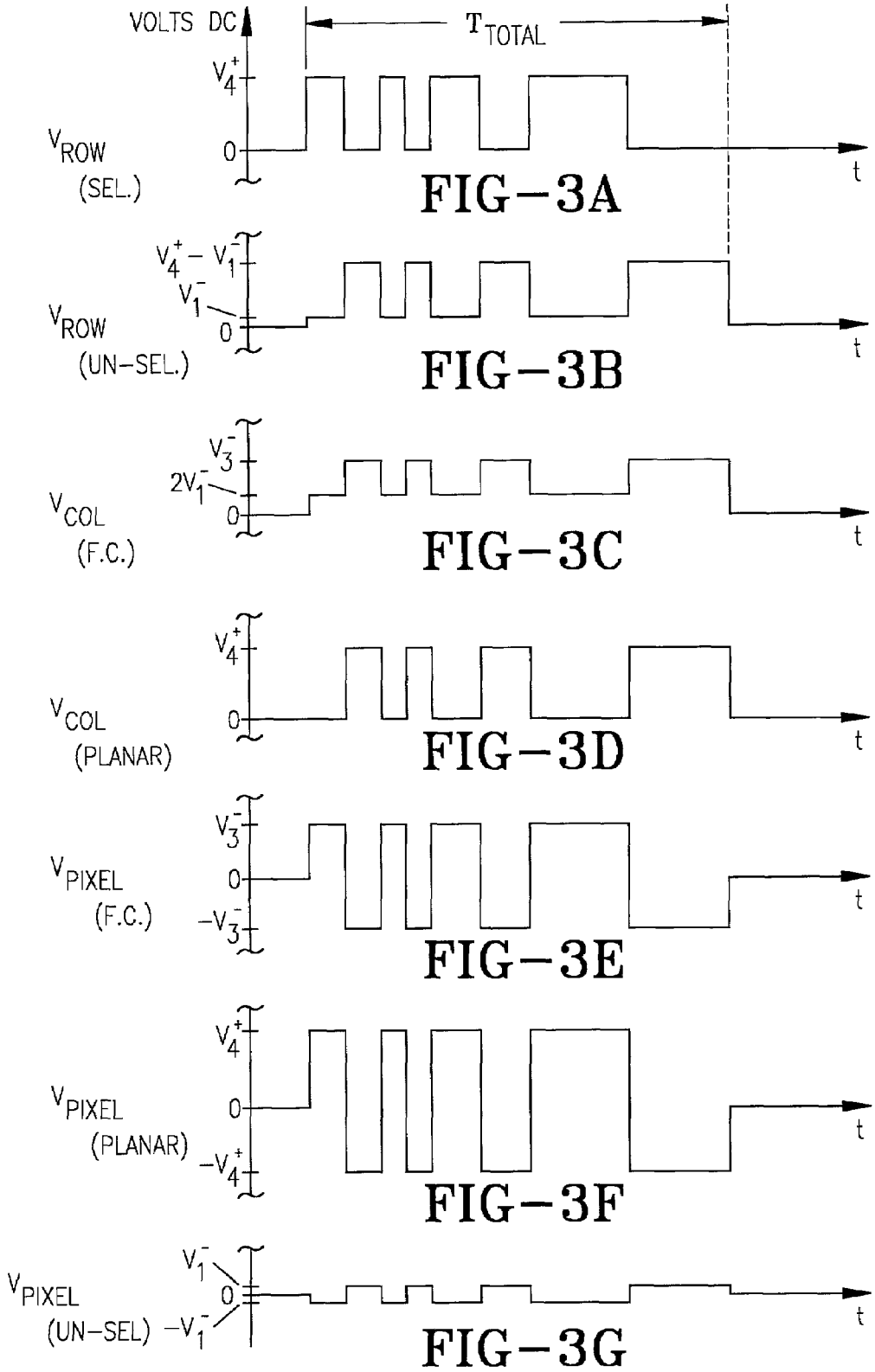
FIGS. 3A–G illustrate a time modulation technique for driving a given CHLCD pixel to the full reflective planar and to the full transparent focal conic texture using uni-polar column and row drive waveforms.

FIG. 3A illustrates the typical waveforms, which would be applied to the row electrode(s), which are selected to be in either the full reflective or full transparent state. FIGS. 3C and 3D illustrate the typical waveforms which would be applied to the corresponding column electrode(s) which are to be driven to the full reflective (FIG. 3D) or full transparent (FIG. 3C) state. At any instance of time, the voltage across the corresponding pixels within the selected row, $V_{pixel}(t)$ equals the difference between the instantaneous voltage applied to the row electrode(s) $V_{row}(t)$, minus the instantaneous voltage applied to the column electrode(s) $V_{column}(t)$. Hence, the following equation applies:

$$V_{pixel}(t)=V_{row}(t)-V_{column}(t) \quad (1)$$

As illustrated in FIG. 3E, the resultant full transparent pixel voltage is the difference between the selected row voltage in FIG. 3A and the full transparent column voltage in FIG. 3C. Likewise, the resultant full reflective pixel voltage illustrated in FIG. 3F is the difference between the selected row voltage in FIG. 3A and the full reflective column voltage in FIG. 3D. As illustrated in FIG. 3E, the positive and negative amplitudes of the pixel pulses are equal to $V_3^-$, hence creating a full transparent focal conic state after the pulses are removed from the selected pixels. Likewise, as illustrated in FIG. 3F, the positive and negative amplitudes of the pixel pulses are equal to $V_4^+$, hence creating a full reflective planar state after the selected pulses are removed. It should be noted that "incremental reflectances" refer to those pixels which are driven to a state which includes some combination of focal conic and planar domains. "All reflectances" refer to the incremental reflectances plus a full reflectance (complete planar) and a transparent reflectance (complete focal conic).

Unless a particular application only contains a single row or "common" for the particular display, it is typical practice to create "unselected pixel" waveforms when image data is not being driven onto the corresponding display pixels. Unselected pixel drive waveforms typically have pulse magnitudes below the $V_1$ threshold of the corresponding ChLCD, hence the pixel reflective states are not effected by the waveforms. This voltage amplitude is illustrated as $V_1^-$ in FIG. 2.

To create the resultant unselected pixel waveform illustrated in FIG. 3G, the unselected row waveform illustrated in FIG. 3B must:

i. Be 180° out of phase with the row selected waveform illustrated FIG. 3A.

ii. Have an amplitude of $V_1^-$ for its low amplitude half cycle.

iii. Have an amplitude of $V_4^+-V_1^-$ for its high amplitude half cycle.

Furthermore, the low half cycle amplitude of the $V_{column}$ (Full F.C.) must have an amplitude of 2 times $V_1^+$.

Hence the following equation applies:

$$V_1^-=(V_4^+-V_3^-)/2 \quad (2)$$

As illustrated in FIG. 3G, the resultant un-selected pixel voltage is the difference between the unselected row voltage in FIG. 3B and the full transparent column voltage in FIG. 3C. Using equation 1, $1^{st}$ half cycles of FIG. 3G equals $V_1^--2(V_1^-)$ or $-V_1^-$. Likewise, the $2^{nd}$ half cycle of FIG. 2G equals $(V_4^+-V_1^-)-V_3^-$. Using equation 2 and substituting $2V_1-V_4^+$ for $V_3^-$ provides the following amplitude for the $2^{nd}$ half cycles of FIG. 3G:

$$(V_4^+-V_1^-)--(2V_1^--V_4^+)=+V_1^-$$

If the same analysis is performed on the difference between the unselected row waveform in FIG. 3B and the full reflective column voltage in FIG. 3D, the same resultant unselected pixel voltage illustrated in FIG. 3G is obtained, except the resultant waveform is 180° out of phase with the illustrated 3G signal. Neither the FIG. 3G pixel waveform nor an 180° out of phase 3G waveform will alter the reflective state of the respective pixel(s) after its application.

The same resultant pixel waveforms illustrated in FIGS. 3E through 3G can also be obtained when supplying bi-polar voltages to the row and column pixel electrode(s). The present invention is not limited to the use of either uni-polar or bi-polar voltage waveforms connected to the display electrodes.

Figure 4A:
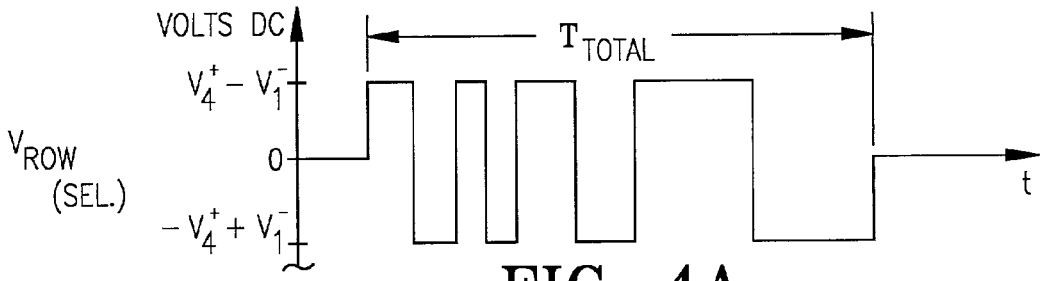
FIGS. 4A–G illustrate a time modulation technique for driving a given ChLCD pixel to the full reflective planar and to the full transparent focal conic texture using bi-polar column and row drive waveforms.
Figure 4B:
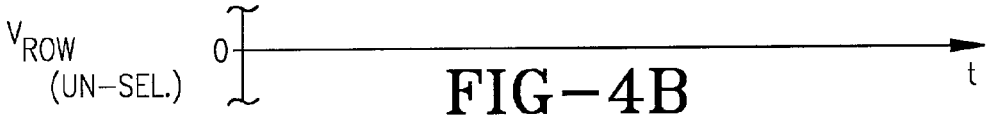
Figure 4C:
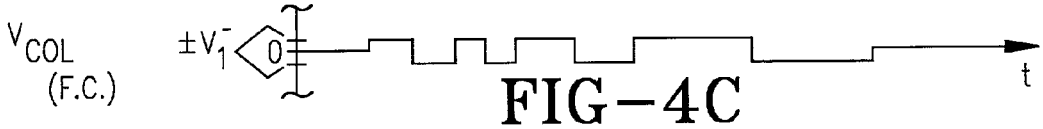
Figure 4D:
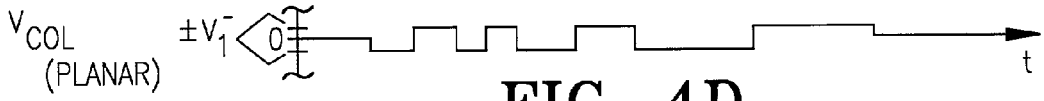

FIG. 4A illustrates the typical bi-polar waveforms, which would be applied to the row electrode(s), which are selected to either the full reflective or full transparent state. FIGS. 4C and 4D illustrate the typical bi-polar waveforms which would be applied to the corresponding column electrode(s) which are to be driven to the full reflective (FIG. 4D) or full transparent (FIG. 4C) state.

Figure 4E:
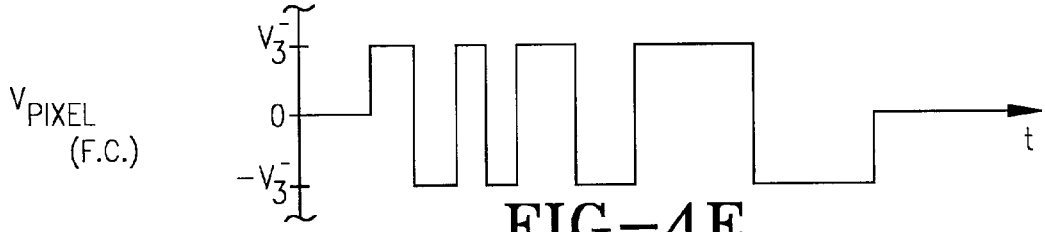
Figure 4F:
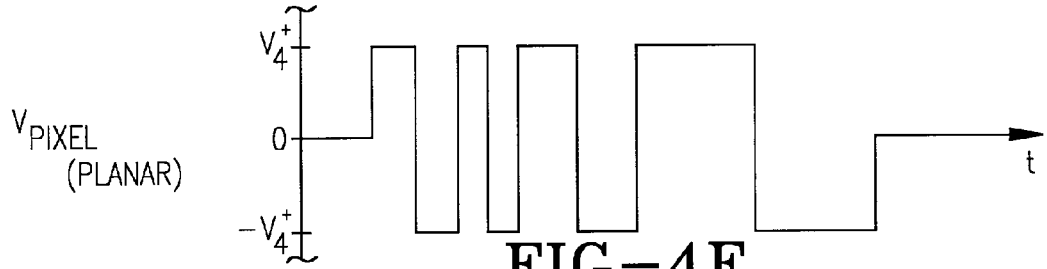

To create the resultant full transparent and full reflective waveforms illustrated in FIGS. 4E and 4F, the following typical rules apply:

a) The positive and negative amplitudes of the bi-polar selected row waveform are halfway between $V_4^+$ and $V_3^-$, or $V_4^+-V_1^-$.

b) The positive and negative amplitudes of both the bi-polar column full reflective and full transparent waveforms are $V_1^-$.

c) The bi-polar column full reflective waveform is out of phase with the selected row waveform, whereas the bi-polar column full transparent waveform is in phase with the selected row waveform.

As illustrated in FIG. 4E, the resultant full transparent pixel voltage is the difference between the selected row voltage in FIG. 4A and the full transparent column voltage in FIG. 4C. Likewise, the resultant full reflective pixel voltage illustrated in FIG. 4F is the difference between the selected row voltage in FIG. 4A and the full reflective column voltage in FIG. 4D. Like FIG. 3E, the resultant bi-polar derived waveform illustrated in FIG. 4E has positive and negative amplitudes equal to $V_3^-$. Likewise the positive and negative amplitudes of the pixel pulses in FIG. 4G are equal to $V_4^+$, hence creating a full reflective planar state after the pulses are removed from the selected pixels.

Figure 4G:
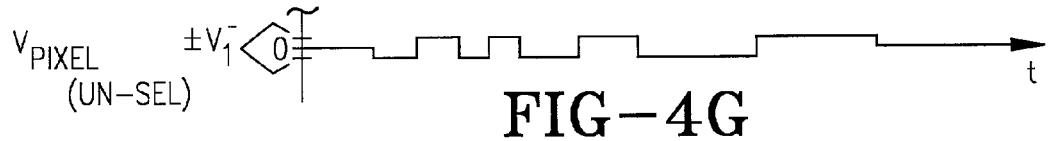
Figure 5A:
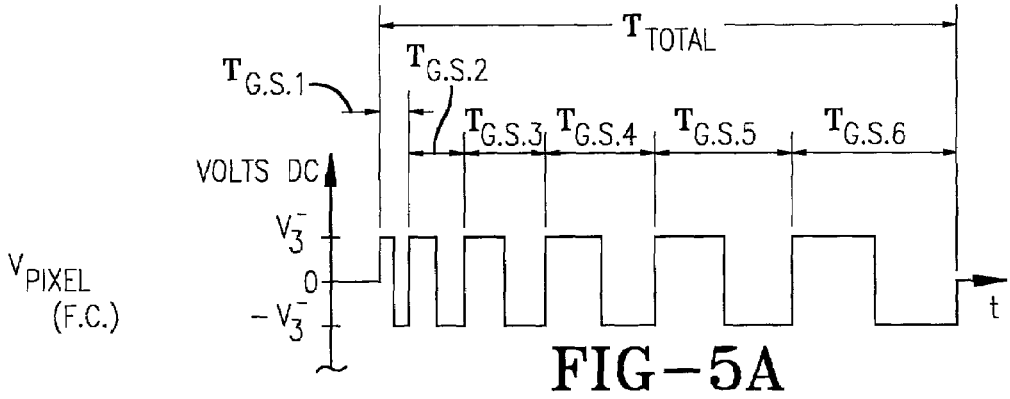
FIGS. 5A–H illustrate the resultant pixel waveforms using the time modulation gray scale technique using a unique drive frequency component for each intermediate gray level.
Figure 5B:
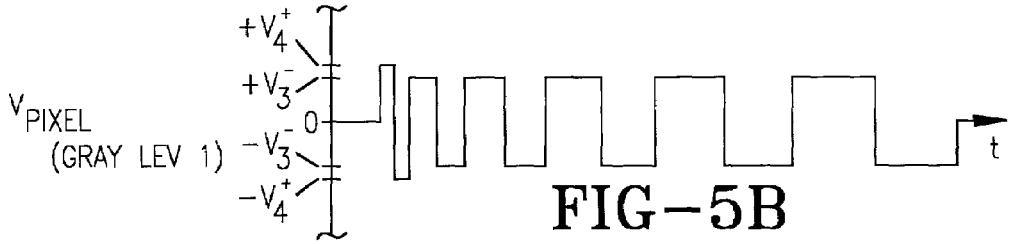
Figure 5C:
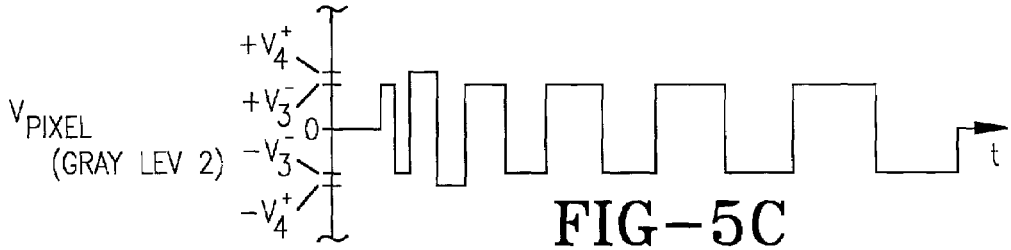
Figure 5D:
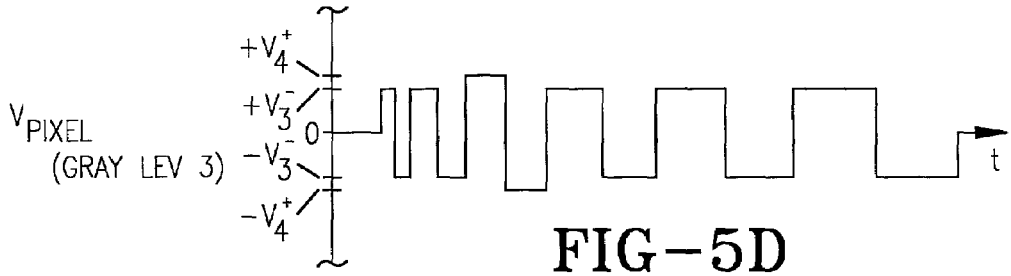
Figure 5E:
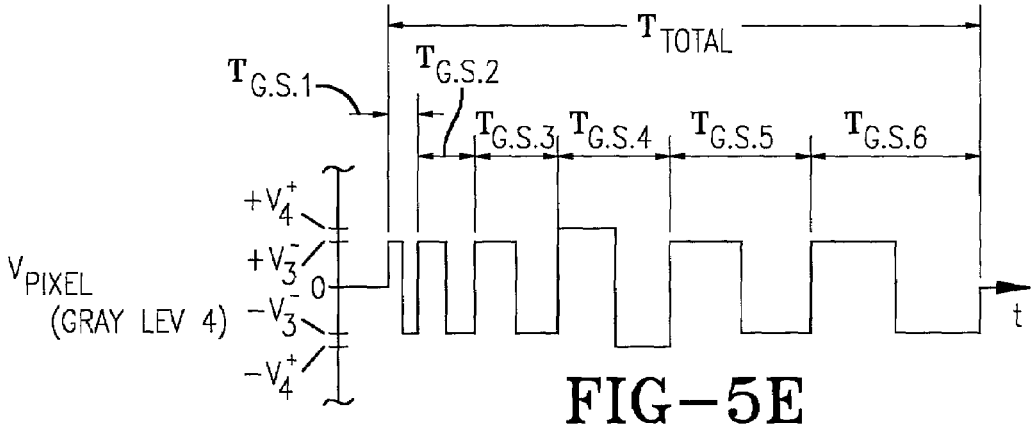
Figure 5F:
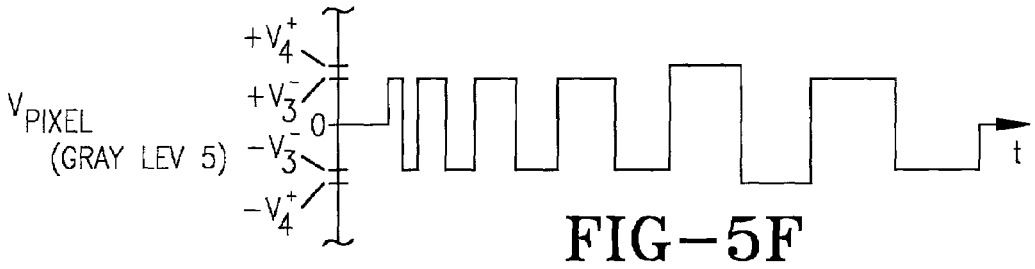
Figure 5G:
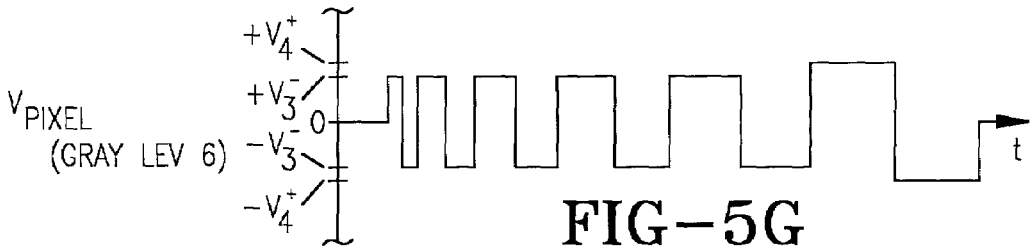
Figure 5H:
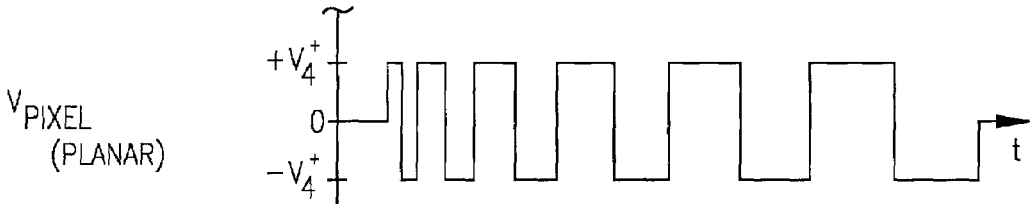

Like the waveform illustrated in FIG. 3G, the resultant FIG. 4G un-selected pixel waveform derived from bi-polar sources is 180° out of phase with the corresponding waveform applied to the column electrode. This is possible since the bi-polar un-selected row waveform is typically at a 0 volt potential, as illustrated in FIG. 4B.

To create different levels of gray shades between full planar and full focal conic, the same type of drive waveforms illustrated in FIGS. 3 or 4 are used, however rather than applying the full transparent or full planar column waveforms illustrated in FIGS. 3C, 3D or 4C, 4D during a corresponding row selection waveform application, different column waveforms are applied.

The reflective state of cholesteric material in a ChLCD is proportional to the magnitude or area integrated under the waveform applied, after the corresponding electric field (or voltage waveform) is removed from the corresponding selected ChLCD pixel(s). The resultant gray level achieved is proportional to the ratio; the duration of the $V_4^+$ amplitude pulses applied, to the total duration ($T_{total}$) of all the selected signals applied, provided the corresponding pixels are reset to the focal conic state prior to application. Different reflectance dependencies will exist if the corresponding pixels are reset to the planar state.

One method to achieve multiple gray levels using different frequency drive components is to assign a different drive frequency component for each of the desired gray levels. To achieve a certain gray level, one would need to apply a $V_4^+$ amplitude drive component of that corresponding frequency, while applying $V_3^+$ amplitude components of the remaining frequencies. For instance, to achieve 8 total gray shades from full focal conic to full planar (with 6 intermediate levels numbered 1 to 6 respectively) the drive period (which is the inverse of the drive frequency) of the corresponding components would obey the relationship outlined in equation 3:

$$T_{G.S.1}<T_{G.S.2}<T_{G.S.3}<T_{G.S.4}<T_{G.S.5}<T_{G.S.6} \quad (3)$$

Where:

$T_{G.S.1}$=drive period for gray scale level 1 component $T_{G.S.2}$=drive period for gray scale level 2 component $T_{G.S.3}$=drive period for gray scale level 3 component $T_{G.S.4}$=drive period for gray scale level 4 component $T_{G.S.5}$=drive period for gray scale level 5 component $T_{G.S.6}$=drive period for gray scale level 6 component Using this multiple frequency method as best seen in FIGS. 5A–H, which directly correspond with Equations 4–11, the following electronic field magnitudes (or voltage magnitudes) would be required to produce the described 8 gray level reflective states:

| | | |
|---|---|---|
| 1. Full Transparent (Focal Conic): | $T_{G.S.1}V_3^- + T_{G.S.2}V_3^- + T_{G.S.3}V_3^- + T_{G.S.4}V_3^- + T_{G.S.5}V_3^- + T_{G.S.6}V_3^-$ | (4) |
| 2. Gray Level 1: | $T_{G.S.1}V_4^+ + T_{G.S.2}V_3^- + T_{G.S.3}V_3^- + T_{G.S.4}V_3^- + T_{G.S.5}V_3^- + T_{G.S.6}V_3^-$ | (5) |
| 3. Gray Level 2: | $T_{G.S.1}V_3^- + T_{G.S.2}V_4^+ + T_{G.S.3}V_3^- + T_{G.S.4}V_3^- + T_{G.S.5}V_3^- + T_{G.S.6}V_3^-$ | (6) |
| 4. Gray Level 3: | $T_{G.S.1}V_3^- + T_{G.S.2}V_3^- + T_{G.S.3}V_4^+ + T_{G.S.4}V_3^- + T_{G.S.5}V_3^- + T_{G.S.6}V_3^-$ | (7) |
| 5. Gray Level 4: | $T_{G.S.1}V_3^- + T_{G.S.2}V_3^- + T_{G.S.3}V_3^- + T_{G.S.4}V_4^+ + T_{G.S.5}V_3^- + T_{G.S.6}V_3^-$ | (8) |
| 6. Gray Level 5: | $T_{G.S.1}V_3^- + T_{G.S.2}V_3^- + T_{G.S.3}V_3^- + T_{G.S.4}V_3^- + T_{G.S.5}V_4^+ + T_{G.S.6}V_3^-$ | (9) |
| 7. Gray Level 6: | $T_{G.S.1}V_3^- + T_{G.S.2}V_3^- + T_{G.S.3}V_3^- + T_{G.S.4}V_3^- + T_{G.S.5}V_3^- + T_{G.S.6}V_4^+$ | (10) |
| 8. Full Reflective (Planar): | $T_{G.S.1}V_4^+ + T_{G.S.2}V_4^+ + T_{G.S.3}V_4^+ + T_{G.S.4}V_4^+ + T_{G.S.5}V_4^+ + T_{G.S.6}V_4^+$ | (11) |

The order of the different frequency pulses illustrated has no, or very little effect on the reflective state of the corresponding pixel(s). For instance, an opposite order of $T_{G.S.6}$, $T_{G.S.5}$, $T_{G.S.4}$, $T_{G.S.3}$, $T_{G.S.2}$ then $T_{G.S.1}$ pulses would achieve the same results. The gray scale technique indicated in the summation equations above is not limited to 8 levels of gray. For instance, 16 levels of gray could be achieved by adding $T_{G.S.7}$ through $T_{G.S.14}$ components to the above summation equations. Four levels of gray can be achieved by omitting the $T_{G.S.3}$ through $T_{G.S.6}$ components. An alternate method of implementation would be to add a $7^{th}$ drive component to the example with duration greater than $T_{G.S.6}$ to be used for creation of the full reflective planar state. If this method is implemented, the additional component would be assigned a $V_4^+$ amplitude, whereas the remaining components would be assigned a $V_3^-$ amplitude when creating the full planar reflective state. The implementation of Equation 3 is important for this drive scheme. It is imperative that all of the gray scale time periods (i.e., G.S.$\chi$) be different from each other. This ensures that the area integrated under each pulse waveform is associated with a specific gray scale reflectance value.

Although the multiple frequency gray scale drive method outlined in Equation 3 and the summation Equations 4–11 achieve consistent results, it is believed that a better method of combining the unique gray scale frequency components is desired to decrease the mean drive frequency and to minimize the image update time. Using the eight gray scale levels discussed previously, the same results can be obtained with only four drive components. The drive period for three of the four corresponding components would obey the relationship outlined in equation 12:

$$T_{1x}<T_{2x}<T_{4x} \quad (12)$$

where:

$T_{1x}$ is approximately half the duration of $T_{2x}$. and $T_{2x}$ is approximately half the duration of $T_{4x}$.

The duration of a $4^{th}$ component, $T_{prep}$, is dependant upon the desired reflectance amount for the $1^{st}$ gray scale level. It has been found that $V_4^+$ pulses applied for a $T_{prep}$ duration are typically required for all reflective states, except the full transparent state when the corresponding pixels were reset to a focal conic state prior to application of the selected voltages. A different type of preparation type pulse maybe required if a different pixel reset technique is used.

As illustrated in FIGS. 6A through 6H, the following electronic field (or "voltage") magnitudes are required to produce the following reflective states:

| | | |
|---|---|---|
| Full Transparent (Focal Conic): | $T_{prep}V_3^- + T_{1x}V_3^- + T_{2x}V_3^- + T_{4x}V_3^-$ | (13) |
| Gray Level 1: | $T_{prep}V_4^+ + T_{1x}V_4^+ + T_{2x}V_3^- + T_{4x}V_3^-$ | (14) |
| Gray Level 2: | $T_{prep}V_4^+ + T_{1x}V_3^- + T_{2x}V_4^+ + T_{4x}V_3^-$ | (15) |
| Gray Level 3: | $T_{prep}V_4^+ + T_{1x}V_4^+ + T_{2x}V_4^+ + T_{4x}V_3^-$ | (16) |
| Gray Level 4: | $T_{prep}V_4^+ + T_{1x}V_3^- + T_{2x}V_3^- + T_{4x}V_4^+$ | (17) |
| Gray Level 5: | $T_{prep}V_4^+ + T_{1x}V_4^+ + T_{2x}V_3^- + T_{4x}V_4^+$ | (18) |
| Gray Level 6: | $T_{prep}V_4^+ + T_{1x}V_3^- + T_{2x}V_4^+ + T_{4x}V_4^+$ | (19) |
| Full Reflective (Planar): | $T_{prep}V_4^+ + T_{1x}V_4^+ + T_{2x}V_4^+ + T_{4x}V_4^+$ | (20) |

From Equations 13–20, it is evident that the following parameters are utilized. The order of the different frequency pulses illustrated has no, or very little effect on the reflective state of the corresponding pixel(s). For instance, an opposite order of $T_{4x}$, $T_{2x}$, $T_{1x}$ then $T_{prep}$ pulses would achieve the same results. The ChLCD gray scale technique illustrated in FIGS. 60–H example is not limited to eight levels of gray.

For instance, 16 levels of gray could be achieved by adding pulses for a corresponding $T_{8x}$ duration. Four levels of gray can be achieved by omitting the pulses applied for the $T_{4x}$ duration. An additional post drive component may be required for a $T_{post}$ duration at a $V_4^+$ or $V_3^-$ amplitude. This may need to be added to produce a more linear reflectance characteristic between the desired levels of gray shades. The FIG. 6 example uses only a single $T_{prep}$. component (without a $T_{post}$ component) applied for duration somewhere between $T_{1x}$ and $T_{2x}$. The relationship between the number of pulses applied and the number of reflectance levels is readily apparent. The number of reflectance levels is equal to one—for the preparation pulse (or 2 if a $T_{post}$ pulse is also used)—plus 2 raised to the power of x—, where x is an integer value 1 or greater. Accordingly, if 16 gray levels are desired, x will be equal to 4 and the number of pulses to obtain 16 gray levels will be x+1 or, in this case five (4+1). If a $T_{post}$ pulse is also used, 16 gray levels would require x+2, or six pulse periods (4+2).

Furthermore, the resultant gray scale pixel waveforms illustrated in the FIG. 6 can be derived from uni-polar or bi-polar signals inputs connected to the column and row electrodes, as indicated in FIGS. 3 and 4.

Figure 6A:
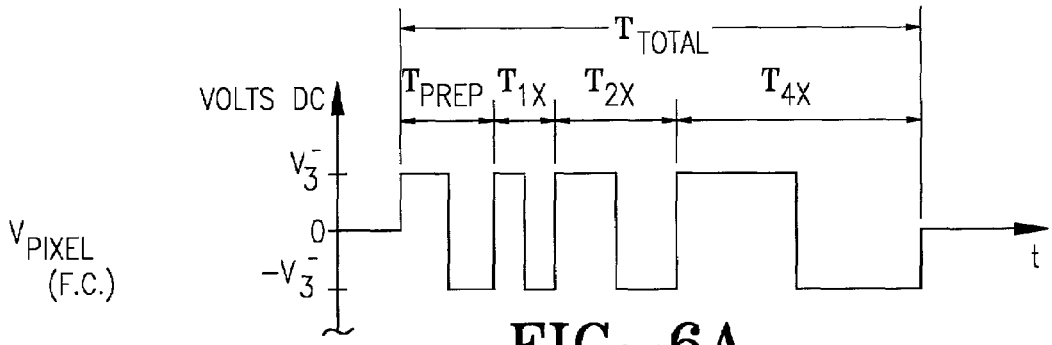
FIGS. 6A–H illustrate the resultant pixel waveforms using an alternative time modulation technique for driving a set of ChLCD pixels to the full reflective planar, full transparent focal conic textures, along with the different reflective states (gray shades) between full planar and full focal conic textures.
Figure 6B:
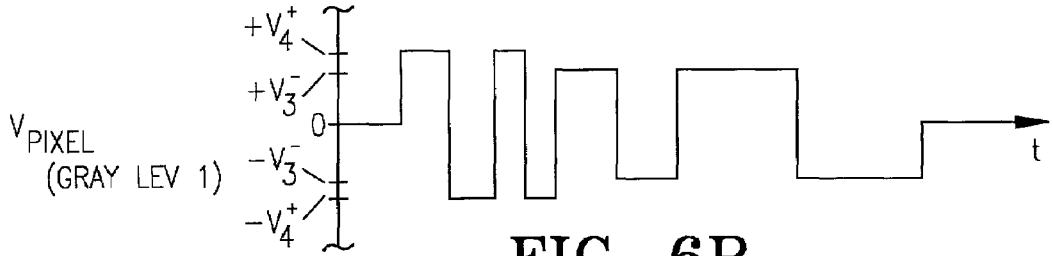
Figure 6C:
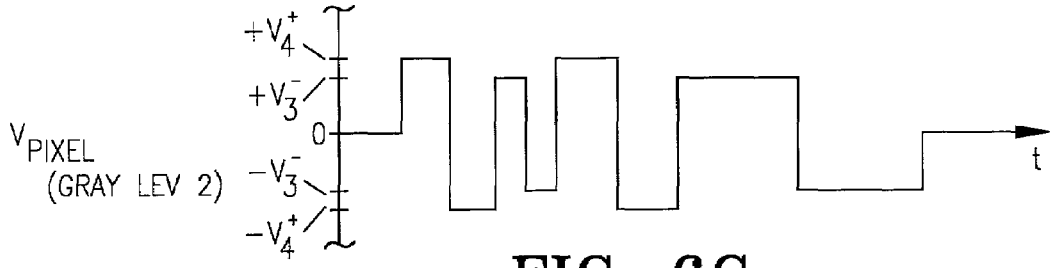
Figure 6D:
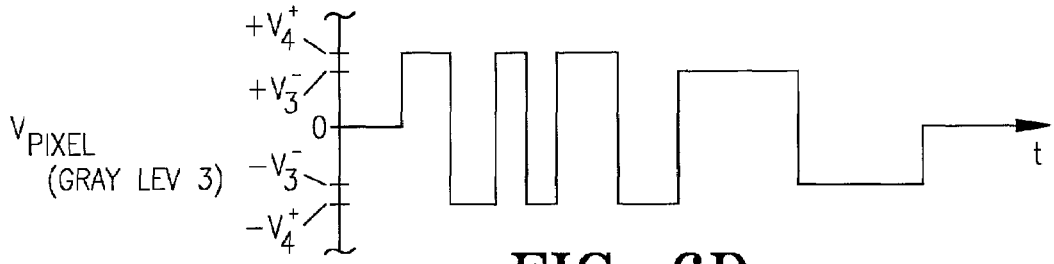
Figure 6E:
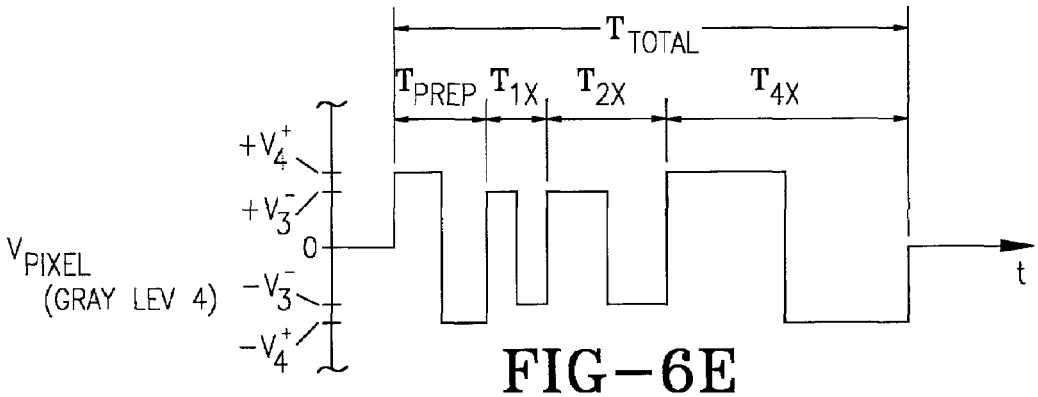
Figure 6F:
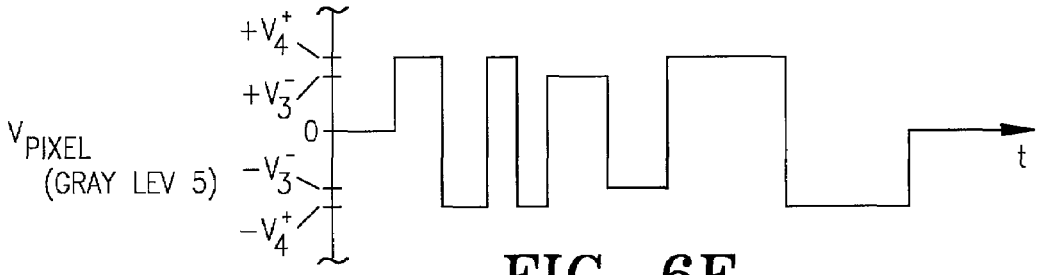
Figure 6G:
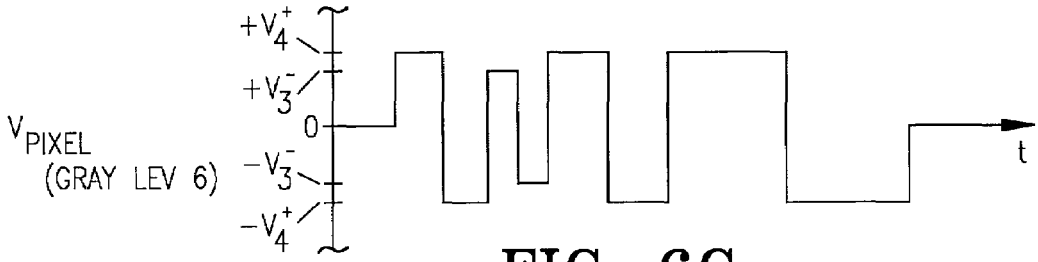
Figure 6H:
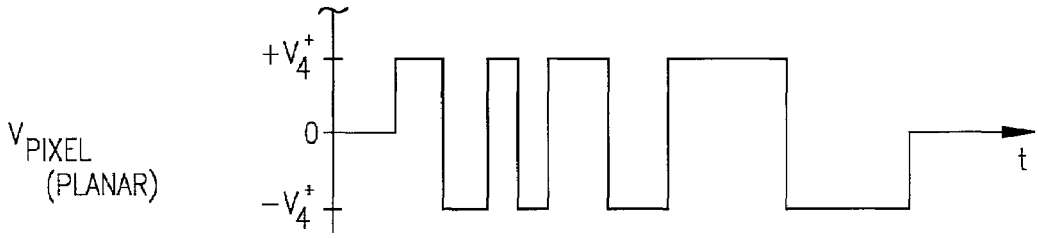
Figure 7A:
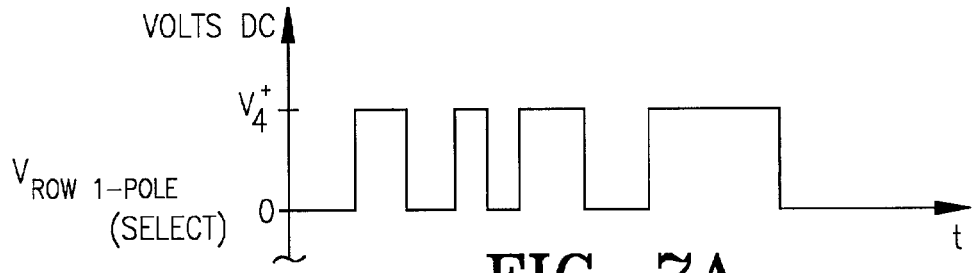
FIGS. 7A–E illustrate the required uni-polar and bi-polar input signals to create the resultant pixel gray level 5 waveform using the alternative time modulation technique.
Figure 7B:
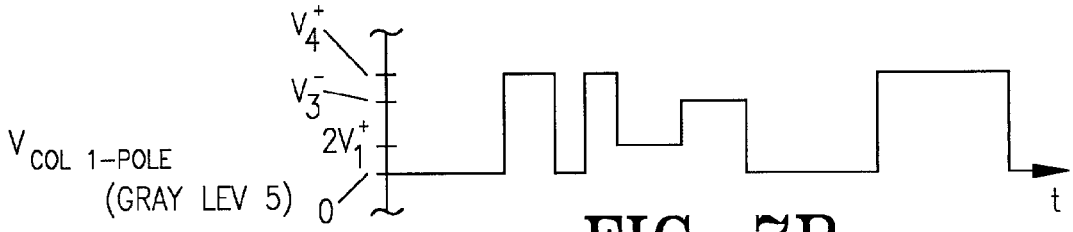
Figure 7C:
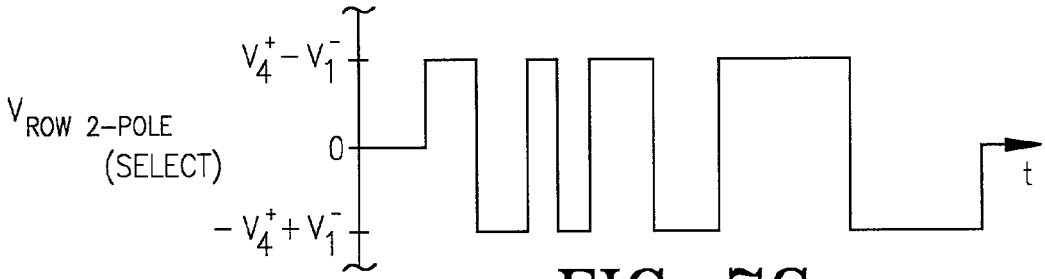
Figure 7D:
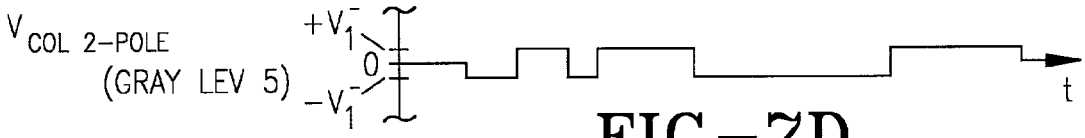
Figure 7E:
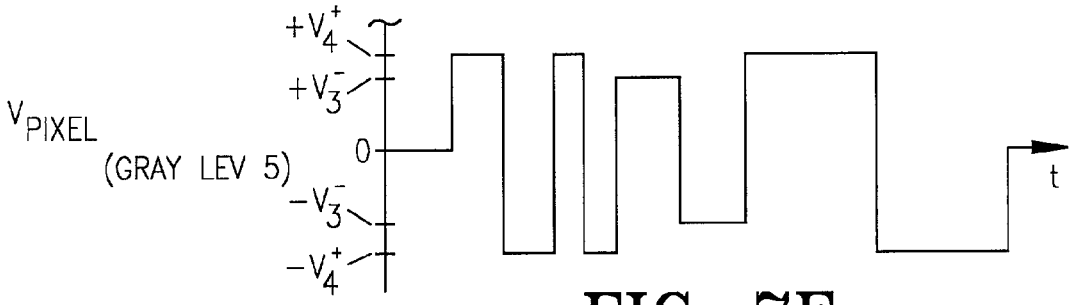

FIGS. 7A–E illustrate how the resultant gray scale level 5 pixel waveform illustrated in FIG. 6F (and FIG. 7E) can be derived using uni-polar and bi-polar inputs. FIG. 7A is identical to the uni-polar selected row waveform illustrated in FIG. 3A. FIG. 7B is the corresponding uni-polar column voltage input, which would be required to create the resultant FIG. 7E gray level 5 waveform. The difference between 7A and 7B produces the FIG. 7E result, as indicated in equation 1. FIG. 7C is identical to the bi-polar selected row waveform illustrated in FIG. 4A. FIG. 7D is the corresponding bi-polar column input, which would be required to create the resultant FIG. 7E gray level 5 waveform. The difference between 7C and 7D also produces the FIG. 7E result.

The advantages of a variable frequency drive scheme are readily apparent. Primarily, an effective gray scale drive scheme for bistable chiral nematic liquid crystal material is enabled that uses time modulation, amplitude modulation, or both modulation techniques. These drive schemes have been found to provide a more consistent appearance for the display. These schemes also allow for an overall reduction in the drive frequency, thus saving power, and increasing image update speed when compared to prior pulse number modulation techniques documented in the prior art. These schemes are also easier to implement and, accordingly, reduce the cost of the drive circuitry.

In view of the foregoing, it should thus be evident that a drive scheme for gray scale bistable cholesteric reflective displays as described herein accomplishes the objects of the present invention and otherwise substantially improves the art.

What is claimed is:

1. A method of addressing a bistable cholesteric liquid crystal material having incremental reflectance properties disposed between opposed substrates, wherein one substrate has a first plurality of electrodes deposited thereon facing the other substrate which has a second plurality of electrodes disposed thereon, the intersection of the first and second plurality of electrodes forming a plurality of pixels, the addressing method comprising:

applying a predetermined number of pulses to the first plurality of electrodes within a set period of time, each said pulse applied to the first electrodes having a different duration drive period within said set period of time;

applying said predetermined number of pulses to the second plurality of electrodes, which is the same number of pulses as applied to said first plurality of electrodes, within said set period of time, each said pulse applied to the second electrodes also having said different duration drive periods within said set period of time; and selectively associating one of two amplitude values with at least one of said predetermined number of pulses applied to the electrodes to generate a desired incremental reflectance the each of the pixels, wherein said desired incremental reflectance is determined by which one of said amplitude values is associated with which one of said different duration drive periods.

2. The method according to claim 1, further comprising:

preparing said liquid crystal material by applying a preparation pulse to the first and second plurality of electrodes, prior to said applying steps.

3. The method according to claim 1, wherein each of said different drive duration periods are applied to the first and second plurality of electrodes at the same time.

4. The method according to claim 1, wherein the number of said predetermined number of pulses correspond to a different number of said desired incremental reflectances.

5. The method according to claim 1, wherein a number of said desired incremental reflectances at each pixel is equal to two raised to the number of said predetermined number of pulses less one, or less a constant value.

6. The method according to claim 1, wherein said pulses are bipolar.

7. The method according to claim 1, wherein said pulses are unipolar.

8. The method according to claim 1, wherein the number of said predetermined number of pulses is equal to a number of said desired incremental reflectances.

9. The method according to claim 8, wherein said number of said desired incremental reflectances corresponds to said number of drive periods, each said drive period having a different length of time than all other said drive periods.

10. The method according to claim 1, wherein said number of said predetermined number of pulses is equal to an exponent number applied to two, wherein the exponent number corresponds to a number of pulses, plus one, or plus a constant value.

11. The method according to claim 10, wherein said exponent number of pulses corresponds to said different duration drive periods, each said different duration drive period having a different length of time, and wherein the additional pulse corresponds to a preparation pulse.

12. The method according to claim 11, wherein the shortest drive period is about half the duration of the next longest drive period.

13. The method according to claim 11, wherein each drive period is at least either about twice as long in duration as the next shortest drive period or about half as short in duration as the next longest drive period.

14. A liquid crystal display, comprising:

a pair of opposed substrates having disposed therebetween a cholesteric liquid crystal material, one of said substrates having a first plurality of electrodes disposed thereon facing the other of said substrates which has a second plurality of electrodes, wherein the intersection of said first and second plurality of electrodes form a plurality of pixels; and a drive circuit that applies a predetermined number of pulses to said first plurality of electrodes and said predetermined number of pulses to said second plurality of electrodes, which is the same number of pulses as applied to said first plurality of electrodes, within a set period of time, each of said predetermined number of pulses having a different duration drive period within said set period of time, said drive circuit associating one of two amplitude values with at least one of said predetermined number of pulses to generate a desired incremental reflectance for each of the pixels which is determined by which one of said amplitude values is associated with which one of said different duration drive periods.

15. The liquid crystal display according to claim 14, wherein said driver circuit applies each of said different duration drive periods to said first and second plurality of electrodes at the same time.

16. The liquid crystal display according to claim 14, wherein the number of said predetermined number of pulses correspond to a different number of incremental reflectances.

17. The liquid crystal display according to claim 14, wherein the number of said predetermined number of pulses is equal to a number of incremental reflectances.

* * * * *